US011192767B2

(12) United States Patent
Caffa et al.

(10) Patent No.: US 11,192,767 B2
(45) Date of Patent: Dec. 7, 2021

(54) CAPPING HEAD FOR THE APPLICATION OF CAPS ON CONTAINERS OR BOTTLES

(71) Applicant: AROL S.P.A., Canelli (IT)

(72) Inventors: Marco Caffa, Cortemilia (IT); Marco Cipriani, Alpignano (IT)

(73) Assignee: AROL S.P.A., Canelli (IT)

( * ) Notice: Subject to any disclaimer, the term of this patent is extended or adjusted under 35 U.S.C. 154(b) by 245 days.

(21) Appl. No.: 16/342,753

(22) PCT Filed: Oct. 18, 2017

(86) PCT No.: PCT/IB2017/056477
§ 371 (c)(1),
(2) Date: Apr. 17, 2019

(87) PCT Pub. No.: WO2018/073763
PCT Pub. Date: Apr. 26, 2018

(65) Prior Publication Data

US 2020/0048061 A1 Feb. 13, 2020

(30) Foreign Application Priority Data

Oct. 21, 2016 (IT) ..... 102016000106129

(51) Int. Cl.
*B67B 3/20* (2006.01)

(52) U.S. Cl.
CPC ..... *B67B 3/2066* (2013.01); *B67B 3/2093* (2013.01); *B67B 2201/08* (2013.01)

(58) Field of Classification Search
CPC . B67B 3/2066; B67B 3/2093; B67B 2201/08; B65B 55/00; B65B 2210/06;
(Continued)

(56) References Cited

U.S. PATENT DOCUMENTS 2,312,141 A * 2/1943 Wilcox ..... B67B 3/02 53/141
2,322,812 A * 6/1943 Barnes ..... B67B 3/02 53/68
(Continued)

FOREIGN PATENT DOCUMENTS

CN 201343180 Y 11/2009
CN 203653201 U 6/2014
(Continued)

*Primary Examiner* — Nathaniel C Chukwurah
*Assistant Examiner* — Lucas E. A. Palmer
(74) *Attorney, Agent, or Firm* — Howson & Howson LLP

(57) ABSTRACT

A capping head for the application of caps on containers or bottles, as well as a capping assembly, are provided. The capping head comprises a hollow housing internally defining at least a first chamber in which a shaft rotating about a longitudinal axis is housed, the rotating shaft being coupled with the hollow housing through the interposition of a magnetic or electromagnetic decoupling assembly comprising at least a rotor and a stator. The decoupling assembly being suitable to allow a relative rotation between the hollow housing and the rotating shaft when the rotating shaft is subjected to a braking torque exceeding a threshold torque. Means for enhancing the thermal dissipation power generated by the decoupling assembly is located inside the hollow housing.

22 Claims, 4 Drawing Sheets

(58) Field of Classification Search
CPC . B65B 7/28; B65B 7/2835; A61L 2/04; A61L 2202/20
See application file for complete search history.

(56) References Cited

U.S. PATENT DOCUMENTS

| | | | | |
|---|---|---|---|---|
| 2,667,999 | A * | 2/1954 | Vore | B67B 5/00 432/62 |
| 6,240,678 | B1 * | 6/2001 | Spether | B67B 3/2073 53/317 |
| 7,331,157 | B2 * | 2/2008 | Brown | B67B 3/2066 53/317 |
| 7,334,380 | B2 | 2/2008 | Brunee | |
| 7,434,370 | B1 * | 10/2008 | Scott | B65B 7/2835 192/56.4 |
| 7,661,245 | B2 * | 2/2010 | Brown | B67B 3/2066 53/317 |
| 7,765,772 | B2 * | 8/2010 | DeLuca | B67B 3/2086 53/317 |
| 2002/0184853 | A1 * | 12/2002 | Arrant | B65B 7/2835 53/343 |
| 2005/0183388 | A1 | 8/2005 | Cirio | |
| 2010/0212259 | A1 * | 8/2010 | Knieling | B67B 3/2086 53/285 |
| 2011/0072762 | A1 * | 3/2011 | Jakob | B67C 7/0086 53/285 |
| 2012/0227355 | A1 * | 9/2012 | Schoenfelder | B67B 3/2066 53/287 |
| 2013/0000251 | A1 * | 1/2013 | Singur | B67B 3/268 53/287 |
| 2013/0167872 | A1 * | 7/2013 | Weston | A61L 2/04 134/18 |
| 2013/0333325 | A1 * | 12/2013 | Schoenfelder | H02K 16/00 53/287 |
| 2017/0136135 | A1 * | 5/2017 | Feuilloley | B65B 55/04 |
| 2018/0193498 | A1 * | 7/2018 | Fritchie | H05B 6/40 |
| 2019/0177145 | A1 | 6/2019 | Caffa et al. | |
| 2019/0248636 | A1 | 8/2019 | Caffa et al. | |
| 2020/0007015 | A1 | 1/2020 | Cipriani | |
| 2020/0025636 | A1 | 1/2020 | Caffa et al. | |
| 2020/0048060 | A1 | 2/2020 | Caffa et al. | |
| 2020/0087129 | A1 | 3/2020 | Caffa et al. | |
| 2020/0186020 | A1 | 6/2020 | Amerio et al. | |

FOREIGN PATENT DOCUMENTS

| | | | | |
|---|---|---|---|---|
| EP | 2724978 | A2 * | 4/2014 | B67B 3/2066 |
| EP | 2724978 | A2 | 4/2014 | |
| JP | 2003-267488 | A | 9/2003 | |
| JP | 2003267488 | A * | 9/2003 | |

* cited by examiner

FIG. 3b
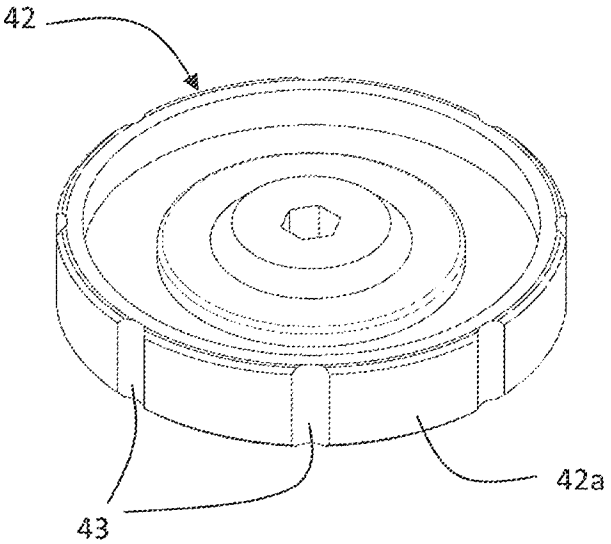
FIG. 6
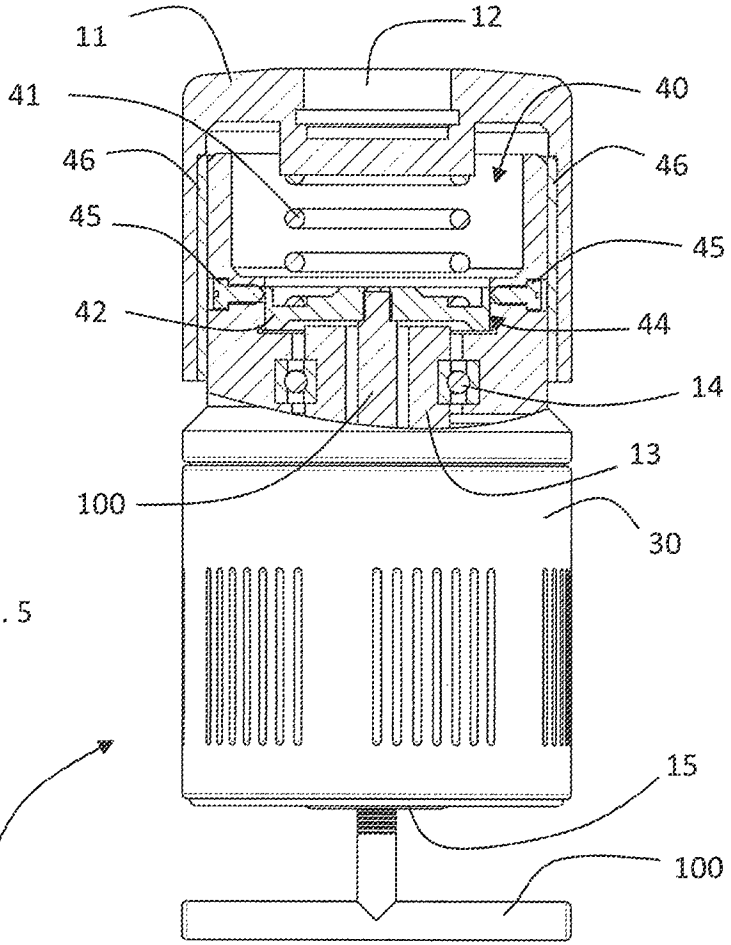
FIG. 5

CAPPING HEAD FOR THE APPLICATION OF CAPS ON CONTAINERS OR BOTTLES

The present invention concerns a capping head for the application of caps on containers or bottles, as well as a capping assembly using at least one such head. More particularly, the present invention concerns a capping head for the application of caps on containers or bottles, capable of obtaining and maintaining aseptic conditions of the inner parts of the head itself.

Capping heads are devices allowing tightly sealing a cap or plug on the mouth of containers or bottles, for instance of the kind intended for containing foodstuffs such as beverages. Capping heads are generally employed in capping assemblies, also referred to as "capping machines", which usually include a movable support moving a plurality of capping heads, generally mounted on the periphery of the same support, by following a path along which also the containers to be capped are conveyed.

More particularly, in order to prevent contamination of the substances to be packaged, capping may be required to take place under sterile conditions. To this end, it is known to cyclically make the outer part of the capping head aseptic by cold or high temperature washing with suitable liquids, and to carry out capping in an area where a controlled atmosphere exists, which is pressurised with sterile air and has been previously sterilised with disinfecting substances.

The prior art capping heads are moreover designed so as to isolate their inner, non-washable part from the outer part by means of suitable gaskets, suitable to prevent passage of both air and liquids in both directions.

Notwithstanding such a measure, it is desirable to sterilise also the inner parts of the capping heads. Indeed such parts, since they operate under high humidity conditions and are not washable, can become breeding grounds of microorganisms. Moreover, isolation between the inner and outer parts of the capping heads offered by the sealing gaskets can become less reliable in time, since gaskets are subjected to wear.

According to the state of the art, it is known to perform a thermal sterilisation of the inner part of the capping heads by means of electrical heaters arranged inside the capping head, but supplied with power from the outside.

Yet, the Applicant has noticed that such a solution, while allowing obtaining at least a local and partial sterilisation of the inside of the capping heads, is not free from drawbacks. Actually, besides the difficulty inherent in supplying moving parts with electric power, such a solution entails the risk of electric dispersions due to the high humidity conditions under which the capping heads operate.

The Applicant has therefore realised that the prior art solutions are not suitable to offer a complete sterilisation of the inner parts of the capping heads, and moreover they make the overall structure of the capping head complex and expensive.

The problem to be solved by the present invention is therefore to provide a capping head which is capable of operating a complete sterilisation of both the inner and the outer parts thereof, without however requiring a power supply from the outside.

Within such a problem, it is an object of the present invention to conceive a capping head having an overall structure that is simple and can be made at limited costs.

In particular, it is another object of the present invention to produce a capping head capable of performing a thermal and controlled self-sterilisation.

In accordance with a first aspect thereof, the invention concerns therefore a capping head for the application of caps on containers or bottles, comprising a hollow housing internally defining at least a first chamber in which a shaft rotating about a longitudinal axis is housed, the rotating shaft being coupled with the hollow housing through the interposition of a magnetic or electromagnetic decoupling assembly comprising at least a rotor and a stator, the magnetic or electromagnetic decoupling assembly being suitable to allow a relative rotation between the hollow housing and the rotating shaft when the rotating shaft is subjected to a braking torque exceeding a threshold torque, characterised in that means for enhancing the thermal dissipation power generated by the magnetic or electromagnetic decoupling assembly are provided inside the hollow housing.

In the present description and in the appended claims, the expression "thermal dissipation power" denotes the thermal power generated by dissipation phenomena occurring inside the capping heads.

In the present description and in the appended claims, the expression "magnetic or electromagnetic decoupling assembly" is intended to denote any one out of a hysteresis magnetic decoupling assembly, a synchronous magnetic decoupling assembly or an electromagnetic decoupling assembly, for instance of the kind employing a brushless motor.

The Applicant has perceived that, by using means for enhancing the thermal dissipation power generated by the decoupling assembly, it is possible to exploit the dissipation effects, which generally occur within capping heads especially when the decoupling assembly is made to work, as a heat source for performing a sterilisation.

To this end, the Applicant has realised that, generally, different kinds of dissipation phenomena generating thermal power take place on the capping heads, which phenomena result from the parasitic energies generated by mechanical friction between the moving members or due to the phenomena of magnetic field variation and/or to the eddy currents generated by the rotation of magnetic fields opposite conductive surfaces in case of a magnetic capping head, or yet due to electromagnetic phenomena in case of a capping head using brushless motors.

According to the state of the art, such parasitic energies are considered as mere dissipation losses and are opposed by suitable minimising techniques.

On the contrary, the Applicant has found how to enhance and control such phenomena in order to exploit them to the advantage of the sterilisation of the inner parts of the capping head.

To this end, the Applicant has studied a suitable thermal model of the capping head by calculating the nominal residual heat under the different operating conditions. More particularly, the Applicant has calculated the additional power amount required to increase the heat amount generated by dissipation in the capping heads according to the state of the art, and has studied specific measures in order to obtain a controlled increase of the heat amount generated, in order to obtain the pasteurisation temperature (about 75 to 85° C.) or the sterilisation temperature (exceeding 130° C.), depending on the specific embodiment.

Advantageously, heat production inside the capping head until attaining the sterilisation temperature, besides making at the moment also the inner part of the head aseptic, also causes vaporisation of any trace of humidity and condensate, thereby making the inner environment more hostile to the formation of breeding grounds of microorganisms.

Moreover, heat production thus induced does not require any kind of electric power supply from the outside.

In accordance with a second aspect thereof, the invention concerns a capping assembly comprising a movable support structure for moving at least one capping head for the application of caps on containers or bottles along a conveying path of containers to be capped, comprising at least one capping head for the application of caps on containers or bottles as described above.

Advantageously, the capping assembly according to the invention attains the technical effects described above in connection with the capping head for the application of caps on containers or bottles.

The present invention may have at least one of the following preferred features, which can be in particular combined together at will in order to cope with specific application requirements.

Preferably, the magnetic decoupling assembly comprises a magnetic rotor shaped as a first hollow cylindrical element and a magnetic stator shaped as a second hollow cylindrical element placed radially more outwards with respect to the first hollow cylindrical element.

More preferably, the magnetic rotor and/or stator consist of a plurality of permanent magnets arranged with alternating polarities along the annular extension of the rotor.

In the alternative, the magnetic rotor or stator consists of a permanent magnet shaped as a hollow cylindrical ring.

According to a further alternative, the magnetic rotor or stator is made of a ferromagnetic material subjected to hysteresis.

More preferably, the stator is connected to the hollow housing in a rotationally fixed manner, but so as to be axially translatable between a position of maximum overlap and a position of minimum overlap with the rotor.

More preferably, the rotor is connected to the rotating shaft in a rotationally fixed manner.

Preferably, the means for enhancing the thermal dissipation power generated by the magnetic or electromagnetic decoupling assembly include at least one coating layer of an outer surface portion of the stator radially facing the rotor, the coating layer being made of a material having a resistivity lower than or equal to 0.5 $\Omega*mm^2/m$.

Preferably, the means for enhancing the thermal dissipation power generated by the magnetic or electromagnetic decoupling assembly include at least one coating layer of an outer surface portion of the rotor radially facing the stator, the coating layer being made of a material having a resistivity lower than or equal to 0.5 $\Omega*mm^2/m$.

More preferably, the coating layer of the surface portion of the stator and/or the rotor is made of a material having a resistivity lower than or equal to 0.1 $\Omega*mm^2/m$.

Even more preferably, the coating layer of the surface portion of the stator and/or the rotor is made of a material having a resistivity lower than or equal to 0.05 $\Omega*mm^2/m$.

Preferably, the coating layer of the surface portion of the stator and/or the rotor is made of any one of the materials, or of more than one of the materials belonging to the group consisting of:

aluminium;
silver;
copper;
gold;
ferrites;
metal alloys;
metal alloys with rare earth elements.

Advantageously, the coating layer made of one of the materials defined above determines the presence of dissipation currents flowing on the coating layer in such an amount as to generate sufficient thermal power to attain the temperatures necessary for pasteurisation or sterilisation.

Moreover, the antibacterial nature of materials such as silver or copper allows attaining an even higher degree of asepticity, by contrasting the lurking of bacteria even in the presence of possible residual humidity inside the capping heads.

Preferably, the means for enhancing the thermal dissipation power generated by the magnetic or electromagnetic decoupling assembly include at least one axial extension element of the stator of the magnetic or electromagnetic decoupling assembly, which element is at least partially made of a material having a resistivity lower than or equal to 0.5 $\Omega*mm^2/m$, more preferably lower than or equal to 0.1 $\Omega*mm^2/m$ or even more preferably lower than or equal to 0.05 $\Omega*mm^2/m$.

More preferably, the axial extension element has an outer surface radially facing the rotor and having a coating layer made of a material having a resistivity lower than or equal to 0.5 $\Omega*mm^2/m$, more preferably lower than or equal to 0.1 $\Omega*mm^2/m$ or even more preferably lower than or equal to 0.05 $\Omega*mm^2/m$.

More preferably, the stator is externally coated with a covering element, the axial extension element of the stator being a portion of the covering element axially projecting beyond the stator.

Even more preferably, the axially projecting portion of the covering element is skirt shaped.

More preferably, the axial extension element extends in opposite direction with respect to the sliding direction allowed to the stator when it moves from the position of maximum overlap with the rotor towards the minimum overlap position.

Advantageously, the provision of an axial extension element of the stator made of a conductive material allows keeping the surface portion contributing to the generation of thermal dissipation power substantially unchanged even when the stator and the rotor are set in a condition of only partial overlap in order to adjust a lower braking torque threshold beyond which the assembly gives rise to the decoupling.

Actually, by axially translating the stator relative to the rotor, the axial extension portion of the stator is positioned opposite the rotor and thus it is subjected to rotary magnetic fields inducing the generation of surface currents in the conductive material said extension is made of or at least coated with, such currents adding to the surface currents already induced in the remaining covering portion externally coating the stator.

Moreover, advantageously, the provision of an axial extension element of the stator allows opposing the losses and the torque non-linearity that can occur as the number of revolutions, and hence the temperature, varies in the capping heads provided with a synchronous or hysteresis magnetic decoupling assembly. Such losses are due to the fact that the temperature increase makes the intensity of the magnetic field generated decrease, with a consequent decrease in the interaction force and torque between the magnets.

The axial extension element ensures that a contactless torque transfer due to the induced currents (Foucault currents) takes place, allowing compensating, according to a complementary law, the variation of the operation curves as both the speed and the temperature change.

For instance, in the condition of minimum axial overlap between the stator and the rotor, the axial extension element enables transferring torques in the lower force intervals.

Under such a condition, a high torque precision and a high behaviour linearity are thus obtained in the absence of cogging phenomena, thereby allowing actuating very precise torques at low intensity.

Moreover, in case of hysteresis magnetic decoupling assemblies, obtaining a torque transfer depending on mixed sources of hysteresis and of induced currents allows varying the system sensitivity depending on the operating torques. More particularly, the effects of the torque components due to the induced currents offer a precision operation.

Therefore, uniformity in the calibration of the hysteresis magnetic decoupling assembly is obtained, since it is possible to determine a specific value of the operating temperature at which a univocal calibration which is no longer subjected to thermal fluctuations is obtained.

More preferably, the axial extension element of the stator comprises a finning radially projecting from at least an outer surface portion opposed to the outer surface radially facing the rotor.

Advantageously, the finning formed on the axial extension element allows a quicker and more uniform thermal distribution, inside the hollow housing, of the heat generated by the same extension due to the interaction with the rotor.

Preferably, the, means for enhancing the thermal dissipation power generated by the magnetic or electromagnetic decoupling assembly include at least one annular element placed in correspondence of the rotor of the magnetic or electromagnetic decoupling assembly in such a way as to define an axial extension of the same, the at least one annular element being at least partially made, or being made at least on its surface, of a material having a resistivity lower than or equal to 0.5 $\Omega*mm^2/m$, more preferably lower than or equal to 0.1 $\Omega*mm^2/m$ or even more preferably lower than or equal to 0.05 $\Omega*mm^2/m$.

More preferably, the at least one annular element has an outer surface radially facing the stator and having a coating layer made of a material having a resistivity lower than or equal to 0.5 $\Omega*mm^2/m$, more preferably lower than or equal to 0.1 $\Omega*mm^2/m$ or even more preferably lower than or equal to 0.05 $\Omega*mm^2/m$.

More preferably, the at least one annular element is placed around the rotating shaft.

Advantageously, also in this case the provision of an annular element determining an axial extension of the stator and made of a good conductor material allows keeping the surface portion contributing to the generation of thermal dissipation power substantially unchanged even when the stator and the rotor are set in a condition of only partial overlap in order to adjust a lower braking torque threshold beyond which the decoupling assembly gives rise to decoupling.

Actually, by axially translating the stator relative to the rotor, the stator is located so as to face the at least one annular axial extension element of the rotor. Since the stator is made of permanent magnets or of ferromagnetic material, it is capable of inducing generation of eddy currents on the outer surface of the annular rotor extension element, thus contributing to the increased generation of dissipation thermal power.

Moreover, the same advantages in terms of adjustment stability and precision as discussed above in connection with the axial extension element of the stator apply also in connection with the axial extension element of the rotor.

Preferably, the coating layer of the surface portion of the stator and/or the coating layer of the surface portion of the rotor and/or the outer surface of the axial extension element of the stator and/or the outer surface of the at least one annular axial extension element of the rotor have at least one sectioning notch.

More preferably, the sectioning notches of the coating layer are obtained by mechanical trimming or by laser trimming.

Advantageously, subdividing the surface into sections separated by the notches formed in the coating layer allows lengthening the electrical paths and hence increasing the amount of dissipation electric current generated on such a coating layer.

Preferably, the means for enhancing the thermal dissipation power generated by the magnetic or electromagnetic decoupling assembly include at least one screen made of a thermally insulating material at least partially coating at least a portion of the inner wall of the hollow housing.

In this manner, it is advantageously ensured that the thermal power generated inside the capping head is not dissipated to the outside, but is kept inside the head in order to attain a sufficient inner temperature to perform a sterilisation of the parts located inside the hollow housing.

Preferably, the hollow housing internally defines a second chamber arranged adjacent to the first inner chamber in axial direction, at least one spring for compensating an axial force being housed in the second inner chamber, wherein a plate movable in axial direction in order to perform an adjustment of the preloading tension of the at least one compensation spring is arranged between the first and the second inner chamber, the rotating shaft being hollow to allow access to the adjustment plate.

Advantageously, the fact that the compensation springs for the controlled application of the axial load are integrated inside the hollow housing allows further improving the overall asepticity of the capping head, while allowing at the same time an adjustment of the preloading tension of the springs. By contrast, in the presence of external springs and the relevant isolating accessories, such as bellows, the adjustment necessarily requires effecting a spring substitution, since the aseptic environment does not allow using external threads for preloading adjustment.

Preferably, the adjustment plate has a threaded peripheral surface coupled with a threaded circular opening interposed between the first and the second inner chamber.

More preferably, the threaded peripheral surface of the adjustment plate includes a plurality of axial longitudinal slots.

Even more preferably, the axial longitudinal slots are arranged at regular angular intervals.

More preferably, a plurality of pressing members radially project from the periphery of the circular opening, which members are suitable to engage with the longitudinal slots of the adjustment plate when the longitudinal slots are at angular positions corresponding to the angular positions of the pressing members.

Even more preferably, the pressing members project from the periphery of the circular opening at regular angular intervals.

Even more preferably, the pressing members are ball-shaped pressing members.

In this manner, it is advantageously possible to achieve a condition in which the adjustment is steadily maintained, by opposing the operational stresses to which the adjustment plate is subjected and which could make it unscrew, thereby altering the adjustment in an improper manner.

Moreover, a gradual adjustment from a minimum to a maximum can be advantageously carried out. Thus, a precise knowledge of the preloading condition imparted is achieved, without need to open or disassemble the whole capping head. More particularly, by suitably choosing the number of pressing members and slots, it is possible to achieve an even fine gradual adjustability of the preloading of the compensation spring.

As a further, but not the last advantage, the number of pressing members allows setting the force resisting to unthreading.

In accordance with a further aspect thereof, the invention concerns a capping head comprising a hollow housing internally defining at least a first chamber in which a shaft rotating about a longitudinal axis is housed, the rotating shaft being coupled with the hollow housing through the interposition of a magnetic or electromagnetic decoupling assembly comprising at least a rotor and a stator, the magnetic or electromagnetic decoupling assembly being suitable to allow a relative rotation between the hollow housing and the rotating shaft when the rotating shaft is subjected to a braking torque exceeding a threshold torque, characterised in that the hollow housing internally defines a second chamber arranged adjacent to the first inner chamber in axial direction, at least one spring for compensating an axial force being housed in the second inner chamber, wherein a plate movable in axial direction in order to perform an adjustment of the preloading tension of the at least one compensation spring is arranged between the first and the second inner chamber, the rotating shaft being hollow in order to allow access to the adjustment plate.

The different features in the individual configurations can be combined together at will according the preceding description, should the advantages specifically resulting from a particular combination have to be exploited.

Figure 2:
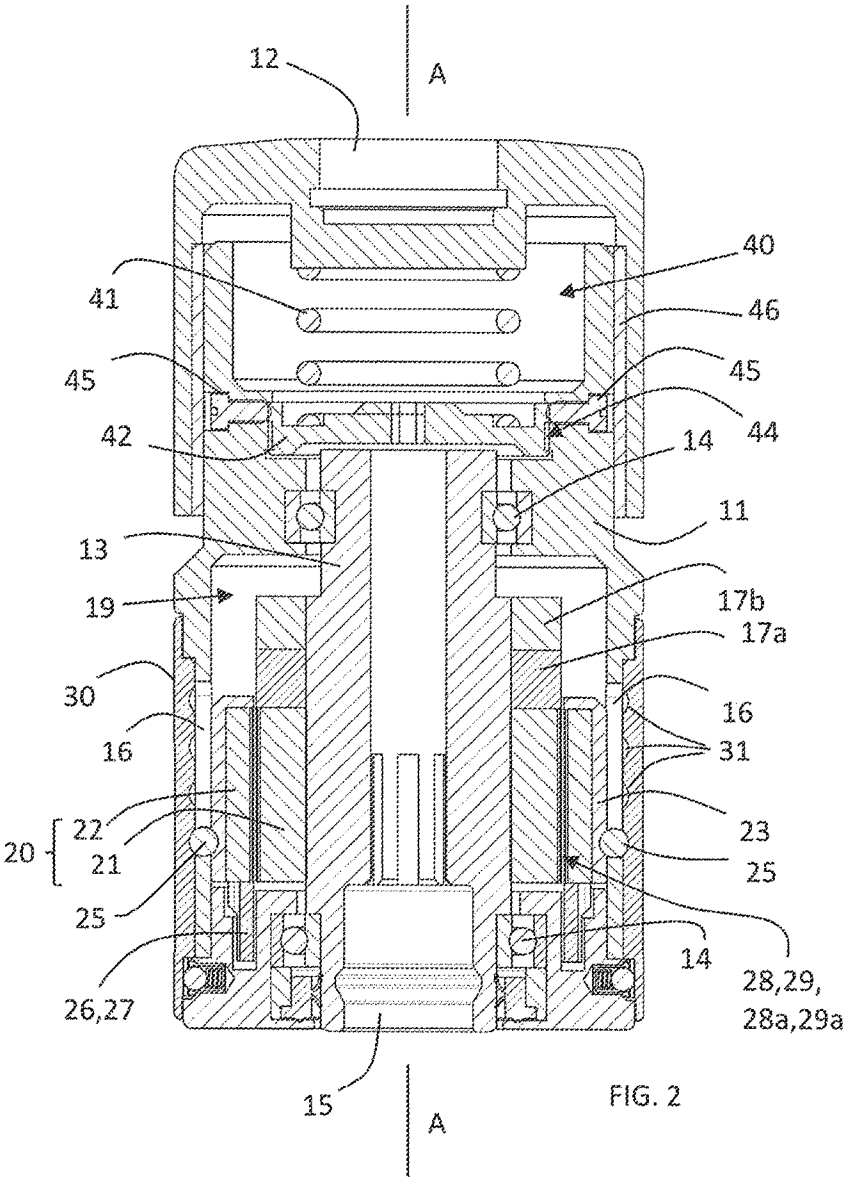
FIG. 2 is a sectional view of the capping head shown in FIG. 1.
Figure 1:
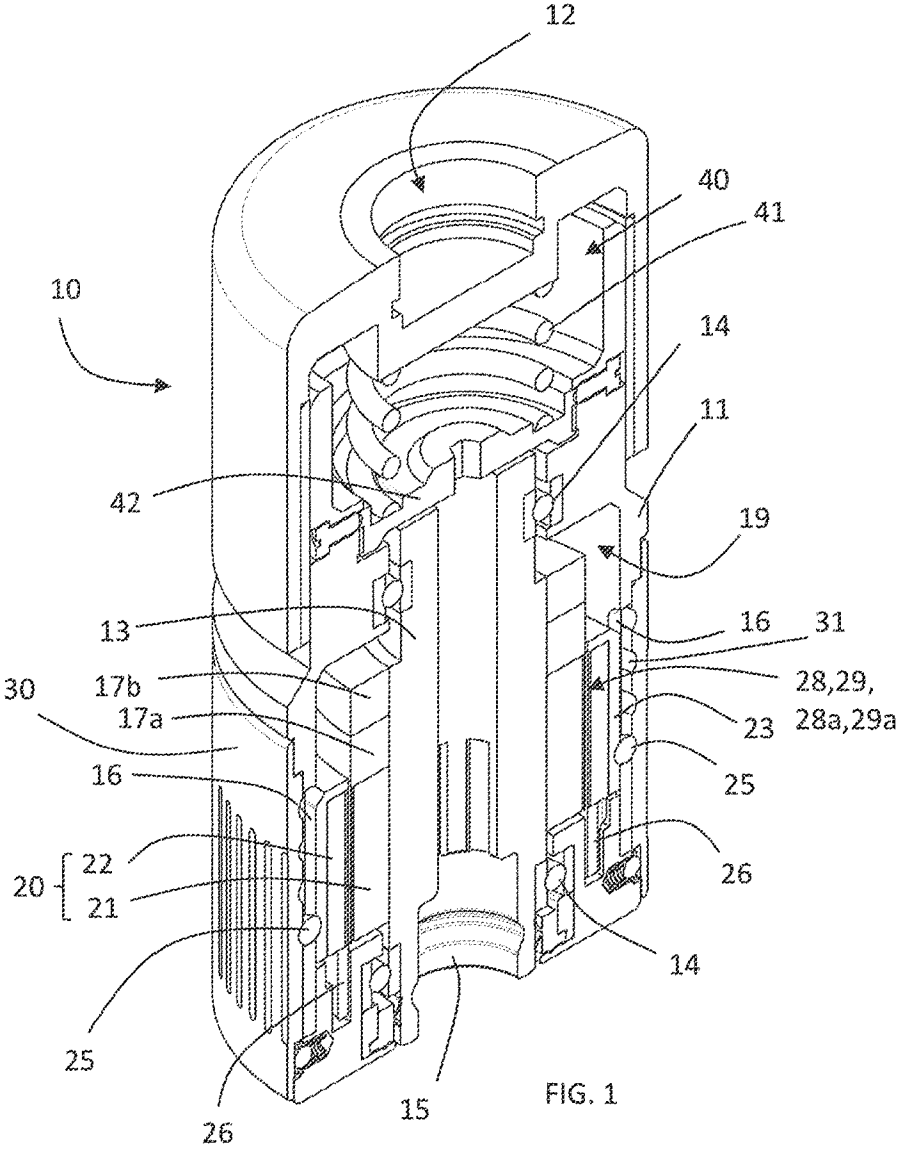
FIG. 1 is a sectional axonometric view of a preferred embodiment of a capping head for the application of caps on containers or bottles according to the present invention.
Figure 3B:
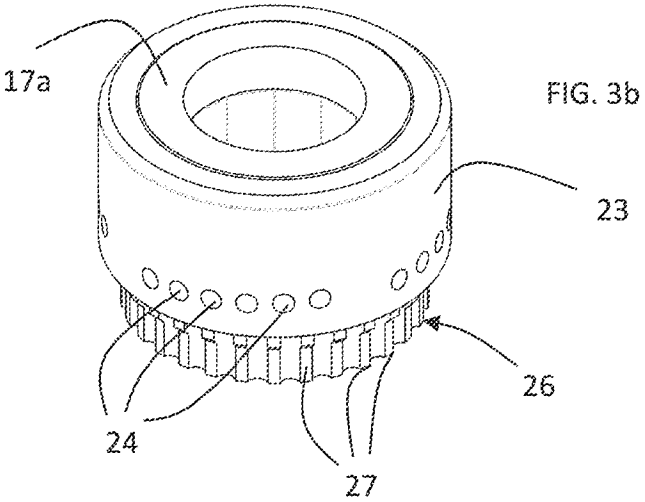
Figure 3A:
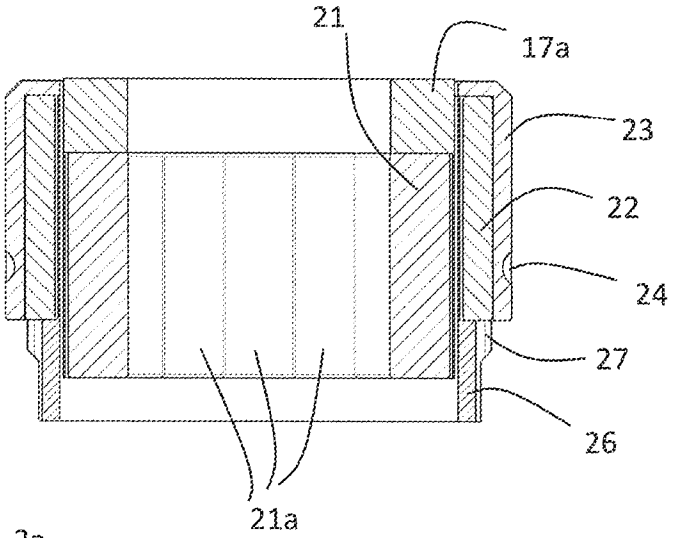
Figure 3C:
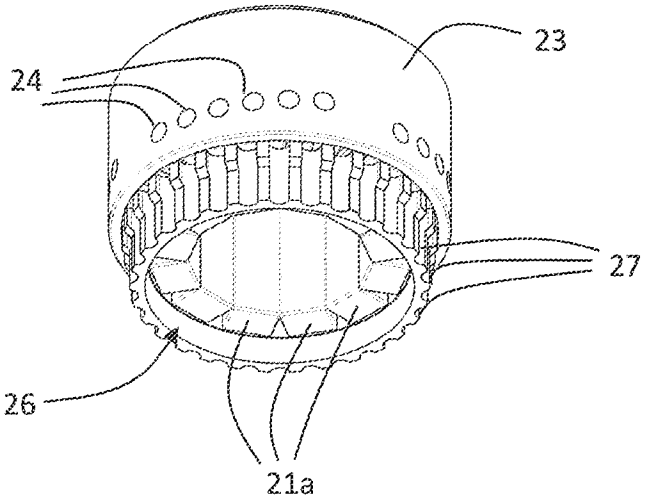

FIG. 3*a* is a sectional view of the rotor—stator assembly of the capping head shown in FIG. 1 with a single annular magnetic element placed above the rotor:

FIGS. 3*b* and 3*c* are axonometric views of the rotor—stator assembly shown in FIG. 3*a;*

Figure 4B:
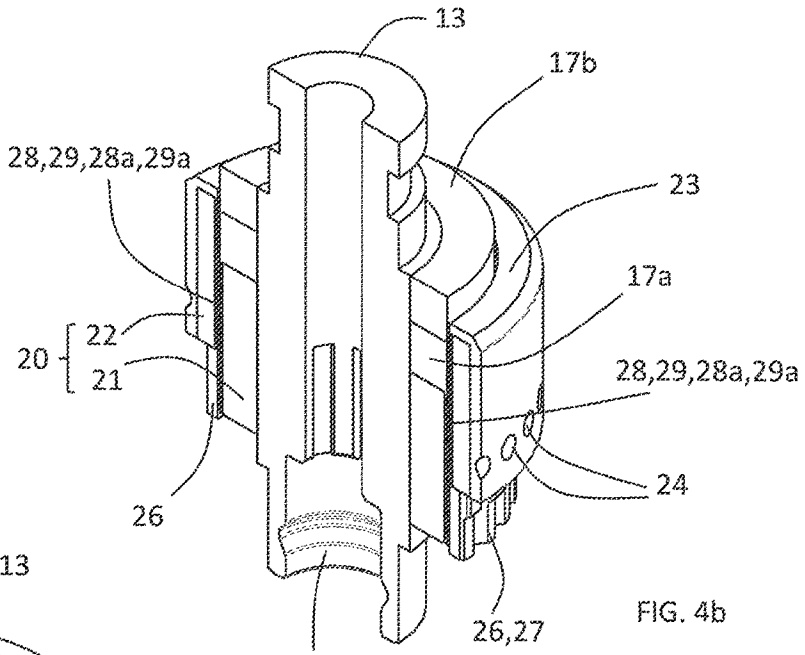
Figure 4C:
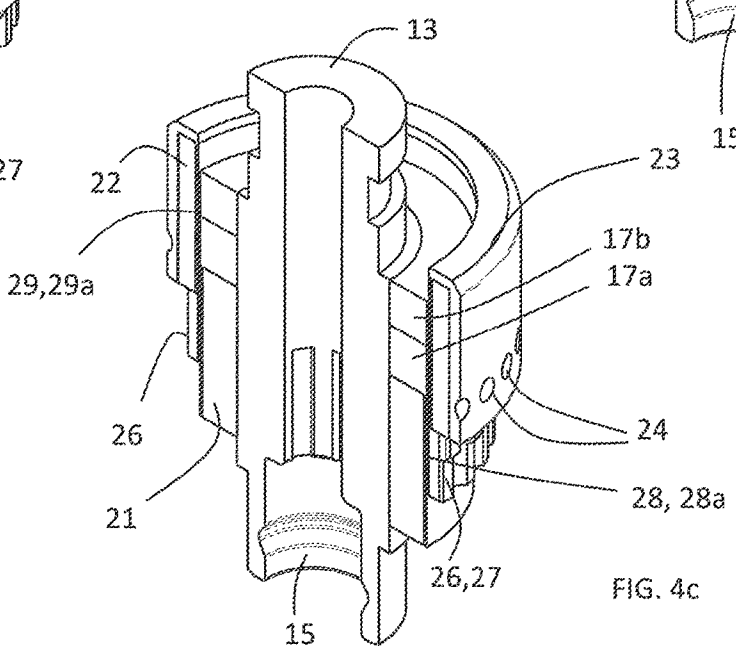
Figure 4A:
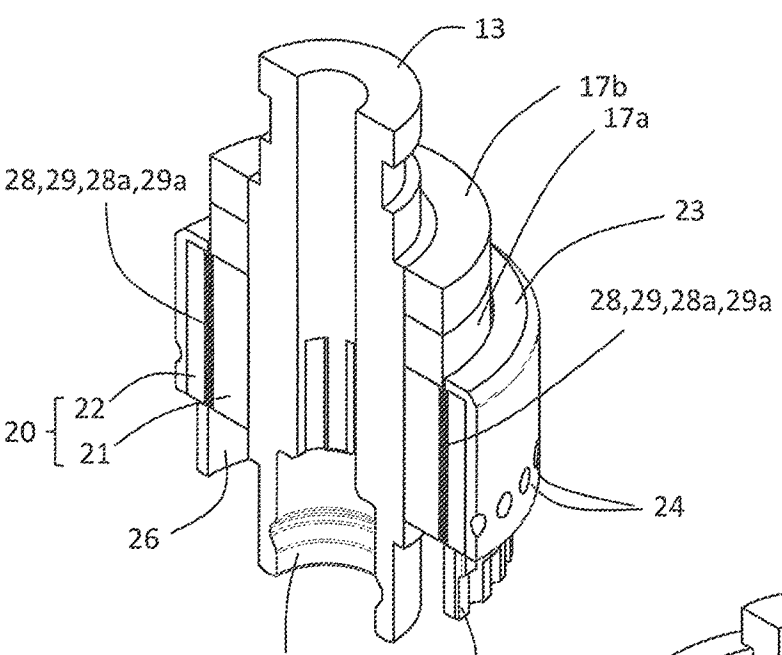

FIGS. 4*a* to 4*c* are partial axonometric views of the rotor—stator assembly of the capping head shown in FIG. 1 in three different axial overlap configurations;

FIG. 5 is a part sectional view of the capping head shown in FIG. 1 with a tool for adjusting the axial load spring inserted therein;

FIG. 6 is an axonometric view of the disc for adjusting the axial load spring of the capping head shown in FIG. 1.

In the following description, for explaining the Figures, the same reference numerals are used to denote constructive elements having the same functions. Moreover, for the sake of clarity of the illustration, it is possible that some reference numerals are not shown in all Figures.

Referring to FIG. 1, there is shown a preferred embodiment of a capping head for the application of caps on containers or bottles according to the present invention, denoted in the whole by reference numeral 10.

Capping head 10 includes a hollow housing 11, provided at its upper side with an interface 12 for coupling with a spindle (not shown) suitable to impart a rotary movement about a longitudinal axis A and/or a translatory movement along that axis.

A rotating shaft 13 carried by hollow housing 11 by means of a pair of rolling bearings 14 is housed within a first chamber 19 defined inside hollow housing 11.

Rotating shaft 13 includes at its lower side an interface 15 for connection to a member (not shown) for gripping a cap.

A magnetic rotor 21, shaped as a first hollow cylindrical element, is mounted on rotating shaft 13 and forms, together with a stator 22 shaped as a second hollow cylindrical element placed radially more outwards with respect to the first element 21, a magnetic decoupling assembly or a magnetic clutch 20.

Magnetic rotor 21 consists of a plurality of permanent magnets 21*a* arranged along its annular extension with alternating polarities.

In the embodiment illustrated, stator 22 is made of a ferromagnetic material subjected to hysteresis. In the alternative, stator 22 may comprise a plurality of permanent magnets 22*a* arranged with alternating polarities along its annular extension.

Stator 22 is connected to hollow housing 11 in a rotationally fixed manner, whereas the axial position of stator 22 inside hollow housing 11 is adjustable in order to set the surface portion over which rotor 21 and stator 22 overlap.

To this end, in the embodiment illustrated, stator 22 is connected to an external covering 23 including a plurality of rolling seats 24 formed on the outer skirt of covering 23. A ball 25 engages in a freely rotatable manner with each of two diametrically opposite seats 24. Moreover, hollow housing 11 is externally coated by an annular ferrule 20 having a helical track 31 on its inner wall. Balls 25 pass through longitudinal slots 16 extending parallel to axis A and formed in the wall of hollow housing 11, and engage also with helical track 31. Slots 16 act as longitudinal guides for balls 25.

Therefore, a rotation of annular ferrule 30 makes balls 25 slide along helical rack 31 and inside slots 16. Consequently, a translatory movement of stator 22 relative to hollow housing 11 occurs, parallel to longitudinal axis A. It is therefore possible to set the surface portion over which rotor 21 and stator 22 overlap. More specifically, stator 22 is movable between a position of maximum overlap with rotor 21, shown in FIG. 4*a*, and a minimum overlap position, shown in FIG. 4*b*, since it is slidable along a direction parallel to axis A.

According to the present invention, external covering 23 of stator 22 includes an axial extension portion 26, made as a skirt, axially extending with respect to covering 23 of stator 22. More particularly, skirt-shaped extension 26 extends in opposite direction with respect to the sliding direction allowed to stator 22 when it moves from the position of maximum overlap with rotor 21 to the minimum overlap position. In this way, when the stator is in the minimum overlap position, skirt-shaped extension 26 faces rotor 21, as shown in FIG. 4*c*.

Skirt-shaped extension 26 has, on its radially external surface, a finning 27 that, by generating turbulence, increases the convection effect, thereby obtaining a quicker dissipation and distribution of the heat generated in skirt-shaped extension 26 because of the rotation of the magnetic field generated by rotor 22, when said extension faces the same rotor 22.

Above rotor 21 two annular elements 17*a*, 17*b* are housed, which are coated with a material having a resistivity lower than 0.5 $\Omega^*mm^2/m$, are located around rotating shaft 13 and have such radial sizes that they do not prevent stator 22 from sliding between the position of maximum overlap and the position of minimum overlap with rotor 21.

Surface 28 of rotor 21 radially facing stator 22 and surface 29 of stator 22 radially facing rotor 21 are each coated with a layer 28*a*, 29*a* of a low resistivity material in order to make generation of eddy currents easier. More specifically, in the embodiment illustrated, coating layers 28*a*, 29*a* are made of silver that, besides having a resistivity of 0.016 $\Omega$*mm$^2$/m, additionally offers antibacterial properties.

Moreover, mutually facing surfaces 28, 29 of rotor 21 and stator 22 have notches (not shown), obtained by trimming, determining a lengthening of the electrical paths, thereby further increasing the eddy currents.

Hollow housing 11 internally defines a second chamber 40 arranged axially adjacent to the first inner chamber 19, at the end of rotating shaft 13 opposed to connection interface 15.

A compensation spring 41 for a controlled transmission of the longitudinal force imparted by the spindle is housed in the second chamber 40.

The first chamber 19 of the hollow housing and the second chamber 40 are separated by means of a plate 42, shown in FIG. 6, for adjusting the preloading tension of compensation spring 41. For preloading adjustment, plate 42 can be made to rotate by means of a tool 42 (shown in FIG. 5) that can be introduced through rotating shaft 13, which to this end is hollow.

Peripheral surface 42*a* of adjustment plate 42 is threaded and has a plurality of vertical longitudinal slots 43 arranged at regular intervals.

Adjustment plate 42 engages with a threaded circular opening 44 separating chambers 19, 40. A plurality of ball-shaped pressing members 45 project from circular opening 44 and engage with vertical slots 43 when the latter are in angular positions facing pressing members 45.

In this manner, a stable screwing position of adjustment plate 42 is defined, thereby preventing a back movement thereof.

Starting from a stable position, plate 42 can again be made to rotate by applying a torsion imparted by means of tool 100, and thus it can be brought to a different (previous or subsequent) stable position. In this manner, a gradual adjustment of the compression of spring 41 to a new level is obtained.

The peripheral wall of the second inner chamber 40 of external housing 11 is coated with a screen 46 of a thermally insulating material.

The operation of capping head 10 for the application of caps on containers or bottles according to the invention is as follows.

When magnetic decoupling assembly 20 is in the configuration of maximum overlap between mutually facing surfaces 28, 29 of stator 22 and rotor 21 (shown in FIG. 4*a*), coating layers 28*a*, 29*a* of such surfaces 28, 29, having a low resistivity and provided with sectioning notches, cause generation of a high amount of surface eddy currents, which consequently give rise to the generation of a sufficient dissipation thermal power to attain pasteurisation and/or sterilisation temperatures, as the cases may be.

When magnetic decoupling assembly 20 is in the configuration of intermediate overlap between mutually facing surfaces 28, 29 of rotor 21 and stator 22 (shown in FIG. 4*b*), a portion of surface 28 of rotor 21 overlaps axial extension portion 26 of stator 22 and a portion of surface 29 of stator 22 overlaps at least one annular element 17*a* placed on the upper side of rotor 21.

The reduced generation of dissipation thermal power due to the only partial overlap of surfaces 28, 29 is compensated by the eddy currents generated on the surfaces of axial extension portion 26 of stator 22 and of annular element 17*a* placed on the upper side of rotor 21.

Actually, axial extension portion 26 of stator 22 facing rotor 21 is subjected to rotating magnetic fields generated by rotor 21, which induce the generation of surface currents in the conductive material of which such extension 26 is made. Moreover, finning 27 provided on that extension portion 26 causes, during rotation, a higher heat exchange towards the inside of the head, thereby determining a quicker and more uniform distribution of the heat generated.

Similarly, also stator 22 is capable of inducing the generation of eddy currents on the outer surface of annular element 17*a* placed above rotor 21.

Thus, both elements 26, 17*a* contribute to enhance the dissipation thermal power generated by magnetic decoupling assembly 20.

Lastly, when magnetic decoupling assembly 20 is in the configuration of minimum overlap between mutually facing surfaces 28, 29 of rotor 21 and stator 22 (shown in FIG. 4*c*), surface 29 of stator 22 overlaps both annular elements 17*a*, 17*b* placed on the upper side of rotor 21, whereas a portion of surface 28 of rotor 21 overlaps axial extension element 26 of stator 22.

Due to the same phenomena as disclosed with reference to FIG. 4*b*, axial extension element 26 and annular elements 17*a*, 17*b* contribute to enhance the dissipation thermal power generated by magnetic decoupling assembly 20, thereby compensating the lower generation of dissipation thermal power due to the even smaller overlap between surfaces 28, 29 of rotor 21 and stator 22.

Moreover, the thermally insulating screen ensures that the thermal power generated inside the capping head is not dissipated towards the outside, thereby allowing in this case that also the second inner chamber 40 attains the sterilisation temperatures.

The features of the capping head for the application of caps on containers or bottles as well as of the corresponding capping assembly according to the present invention are clearly apparent from the above description, as are clearly apparent the relevant advantages.

Further variants of the embodiments described above are possible without departing from the teaching of the invention.

It is clear moreover that a capping head for the application of caps on containers or bottles as conceived is susceptible of several changes and modifications, all lying within the scope of the invention. Moreover all details can be replaced by technically equivalent elements. In the practice, any material, as well any size, can be employed depending on the technical requirements.

The invention claimed is:

1. A capping head (10) for the application of caps on containers or bottles, comprising a hollow housing (11) internally defining at least a first chamber (19) in which a shaft (13) rotating about a longitudinal axis (A) is housed, the rotating shaft (13) being coupled with the hollow housing (11) through the interposition of a magnetic or electromagnetic decoupling assembly (20) configured to generate thermal dissipation power and comprising at least a rotor (21) and a stator (22), the magnetic or electromagnetic decoupling assembly (20) being suitable to allow a relative rotation between the hollow housing (11) and the rotating shaft (13) when the rotating shaft (13) is subjected to a braking torque exceeding a threshold torque, wherein inside the hollow housing (11) there are means for enhancing the thermal dissipation power, said means comprising elements (28*a*, 29*a*, 26, 17*a*, 17*b*) which are different from the rotor (21) and the stator (22) and on which eddy currents flow, wherein said elements (28*a*, 29*a*, 26, 17*a*, 17*b*) which are different from the rotor (21) and the stator (22) and on which eddy currents flow comprise at least one out of:

at least one coating layer (29*a*) of an outer surface portion (29) of the stator (22) radially facing the rotor (21); and/or at least one coating layer (28*a*) of an outer surface portion (28) of the rotor (21) radially facing the stator (22); and/or at least one axial extension element (26) of the stator (22) of the magnetic or electromagnetic decoupling assembly (20); and/or at least one annular element (17*a*, 17*b*) placed at the rotor (21) of the magnetic or electromagnetic decoupling assembly (20) in such a way as to define an axial extension of the same rotor (21) and located around the rotating shaft (13), said at least one annular element (17*a*, 17*b*) having such radial size that it does not prevent stator (22) from sliding between a position of maximum overlap and a position of minimum overlap with rotor (21).

2. The capping head (10) according to claim 1, wherein:

said at least one coating layer (29*a*) of the outer surface portion (29) of the stator (22) radially facing the rotor (21) is made of a material having a resistivity lower than or equal to 0.5 $\Omega*mm^2/m$; and/or said at least one coating layer (28*a*) of the outer surface portion (28) of the rotor (21) radially facing the stator (22) is made of a material having a resistivity lower than or equal to 0.5 $\Omega*mm^2/m$; and/or said at least one axial extension element (26) of the stator (22) of the magnetic or electromagnetic decoupling assembly (20) is at least partially made of a material having a resistivity lower than or equal to 0.5 $\Omega*mm^2/m$; and/or said at least one annular element (17*a*, 17*b*) is at least partially made of a material having a resistivity lower than or equal to 0.5 $\Omega*mm^2/m$.

3. The capping head (10) according to claim 2, wherein the material of which are made the at least one coating layer (29*a*) of the outer surface portion (29) of the stator (22) and/or the at least one coating layer (28*a*) of the outer surface portion (28) of the rotor (21), and/or at least part of the at least one axial extension element (26) of the stator (22) and/or at least part of the at least one axial extension annular element (17*a*, 17*b*) of the rotor (21) is any one or more of the materials belonging to the group consisting of:

aluminum;
silver;
copper;
gold;
ferrites;
metal alloys;
metal alloys with rare earth elements.

4. The capping head (10) according to claim 3, wherein the at least one coating layer (29*a*) of the outer surface portion (29) of the stator (22) and/or the at least one coating layer (28*a*) of the outer surface portion (28) of the rotor (21), and/or at least an outer surface portion of the at least one axial extension element (26) of the stator (22) and/or at least an outer surface portion of the at least one axial extension annular element (17*a*, 17*b*) of the rotor (21) comprise at least one sectioning notch.

5. The capping head (10) according to claim 4, wherein the axial extension element (26) of the stator (22) comprises a finning (27) radially projecting from at least an outer surface portion opposed to an outer surface radially facing the rotor (21).

6. The capping head (10) according to claim 5, wherein the means for enhancing the thermal dissipation power generated by the magnetic or electromagnetic decoupling assembly (20) comprises at least one screen made of a thermally insulating material (46) at least partially coating at least a portion of an inner wall of the hollow housing (11).

7. The capping head (10) according to claim 3, wherein the axial extension element (26) of the stator (22) comprises a finning (27) radially projecting from at least an outer surface portion opposed to an outer surface radially facing the rotor (21).

8. The capping head (10) according to claim 3, wherein the hollow housing (11) internally defines a second chamber (40) arranged adjacent to the first inner chamber (19) in axial direction (A), at least one spring (41) for compensating an axial force being housed in the second inner chamber (40), wherein a plate (42) movable in axial direction in order to perform an adjustment of the preloading tension of the at least one compensation spring (41) is arranged between the first (19) and the second (40) inner chamber, the rotating shaft (13) being hollow to allow the access to the adjustment plate (42).

9. The capping head (10) according to claim 2, wherein the at least one coating layer (29*a*) of the outer surface portion (29) of the stator (22) and/or the at least one coating layer (28*a*) of the outer surface portion (28) of the rotor (21), and/or at least an outer surface portion of the at least one axial extension element (26) of the stator (22) and/or at least an outer surface portion of the at least one axial extension annular element (17*a*, 17*b*) of the rotor (21) comprise at least one sectioning notch.

10. The capping head (10) according to claim 9, wherein the axial extension element (26) of the stator (22) comprises a finning (27) radially projecting from at least an outer surface portion opposed to an outer surface radially facing the rotor (21).

11. The capping head (10) according to claim 9, wherein the hollow housing (11) internally defines a second chamber (40) arranged adjacent to the first inner chamber (19) in axial direction (A), at least one spring (41) for compensating an axial force being housed in the second inner chamber (40), wherein a plate (42) movable in axial direction in order to perform an adjustment of the preloading tension of the at least one compensation spring (41) is arranged between the first (19) and the second (40) inner chamber, the rotating shaft (13) being hollow to allow the access to the adjustment plate (42).

12. The capping head (10) according to claim 2, wherein the axial extension element (26) of the stator (22) comprises a finning (27) radially projecting from at least an outer surface portion opposed to an outer surface radially facing the rotor (21).

13. The capping head (10) according to claim 12, wherein the hollow housing (11) internally defines a second chamber (40) arranged adjacent to the first inner chamber (19) in axial direction (A), at least one spring (41) for compensating an axial force being housed in the second inner chamber (40), wherein a plate (42) movable in axial direction in order to perform an adjustment of the preloading tension of the at least one compensation spring (41) is arranged between the first (19) and the second (40) inner chamber, the rotating shaft (13) being hollow to allow the access to the adjustment plate (42).

14. The capping head (10) according to claim 2, wherein the hollow housing (11) internally defines a second chamber (40) arranged adjacent to the first inner chamber (19) in axial direction (A), at least one spring (41) for compensating an axial force being housed in the second inner chamber (40), wherein a plate (42) movable in axial direction in order to perform an adjustment of the preloading tension of the at least one compensation spring (41) is arranged between the first (19) and the second (40) inner chamber, the rotating shaft (13) being hollow to allow the access to the adjustment plate (42).

15. The capping head (10) according to claim 1, wherein the hollow housing (11) internally defines a second chamber (40) arranged adjacent to the first inner chamber (19) in axial direction (A), at least one spring (41) for compensating an axial force being housed in the second inner chamber (40), wherein a plate (42) movable in axial direction in order to perform an adjustment of the preloading tension of the at least one compensation spring (41) is arranged between the first (19) and the second (40) inner chamber, the rotating shaft (13) being hollow to allow the access to the adjustment plate (42).

16. The capping head (10) according to claim 15, wherein the adjustment plate (42) comprises a threaded peripheral surface (42*a*) coupled with a threaded circular opening (44) interposed between the first (19) and the second (40) inner chamber, the threaded peripheral surface (42*a*) of the adjustment plate (42) comprising a plurality of axial longitudinal slots (43), preferably arranged at regular angular intervals.

17. The capping head (10) according to claim 15, wherein a plurality of pressing members (45) radially project from the periphery of the circular opening (44), which members (45) are suitable to engage with the longitudinal slots (43) of the adjustment plate (42) when the longitudinal slots (43) are at angular positions corresponding to the angular positions of the pressing members (45).

18. The capping head (10) according to claim 1, wherein the rotor (21) and the stator (22) of the magnetic decoupling assembly (20) comprise a magnetic rotor (21) shaped as a first hollow cylindrical element and a magnetic stator (22) shaped as a second hollow cylindrical element placed radially more outwards with respect to the first hollow cylindrical element (21), the stator (22) being connected to the hollow housing (11) in a rotationally fixed manner, but so as to be axially translatable between the maximum overlap position and the minimum overlap position with the rotor (21), the rotor (21) being connected to the rotating shaft in a rotationally fixed manner.

19. A capping assembly comprising a movable support structure for moving at least one capping head (10) for the application of caps on containers or bottles according to claim 1 along a conveying path of containers to be capped.

20. The capping head (10) according to claim 1, wherein the means for enhancing the thermal dissipation power generated by the magnetic or electromagnetic decoupling assembly (20) comprises at least one screen made of a thermally insulating material (46) at least partially coating at least a portion of an inner wall of the hollow housing (11).

21. The capping head (10) according to claim 1, wherein:

said at least one coating layer (29*a*) of the outer surface portion (29) of the stator (22) radially facing the rotor (21) is made of a material having a resistivity lower than or equal to 0.1 $\Omega*mm^2/m$; and/or said at least one coating layer (28*a*) of the outer surface portion (28) of the rotor (21) radially facing the stator (22) is made of a material having a resistivity lower than or equal to 0.1 $\Omega*mm^2/m$; and/or said at least one axial extension element (26) of the stator (22) of the magnetic or electromagnetic decoupling assembly (20) is at least partially made of a material having a resistivity lower than or equal to 0.1 $\Omega*mm^2/m$; and/or said at least one annular element (17*a*, 17*b*) is at least partially made of a material having a resistivity lower than or equal to 0.1 $\Omega*mm^2/m$.

22. The capping head (10) according to claim 1, wherein:

said at least one coating layer (29*a*) of the outer surface portion (29) of the stator (22) radially facing the rotor (21) is made of a material having a resistivity lower than or equal to 0.05 $\Omega*mm^2/m$; and/or said at least one coating layer (28*a*) of the outer surface portion (28) of the rotor (21) radially facing the stator (22) is made of a material having a resistivity lower than or equal to 0.05 $\Omega*mm^2/m$; and/or said at least one axial extension element (26) of the stator (22) of the magnetic or electromagnetic decoupling assembly (20) is at least partially made of a material having a resistivity lower than or equal to 0.05 $\Omega*mm^2/m$; and/or said at least one annular element (17*a*, 17*b*) is at least partially made of a material having a resistivity lower than or equal to 0.05 $\Omega*mm^2/m$.

* * * * *